United States Patent [19]

Hann

[11] Patent Number: 4,910,189

[45] Date of Patent: Mar. 20, 1990

[54] THERMAL TRANSFER DYESHEET

[75] Inventor: Richard A. Hann, Frodsham, England

[73] Assignee: Imperial Chemical Industries PLC, London, England

[21] Appl. No.: 310,510

[22] Filed: Feb. 15, 1989

Related U.S. Application Data

[63] Continuation of Ser. No. 831,722, Feb. 21, 1986, abandoned.

[30] Foreign Application Priority Data

Feb. 21, 1985 [GB] United Kingdom ..... 8504518

[51] Int. Cl.[4] ..... B41M 5/035; B41M 5/26

[52] U.S. Cl. ..... 503/227; 8/471; 428/195; 428/447; 428/913; 428/914

[58] Field of Search ..... 8/471; 428/195, 447, 428/484, 488.1, 488.4, 913, 914; 430/945; 503/227

[56] References Cited

U.S. PATENT DOCUMENTS 4,724,228 2/1988 Hann ..... 503/227

FOREIGN PATENT DOCUMENTS

| | | | |
|---|---|---|---|
| 0036936 | 10/1981 | European Pat. Off. | 428/913 |
| 0076490 | 4/1983 | European Pat. Off. | 428/514 |
| 48-11409 | 4/1973 | Japan | 503/227 |
| 1230986 | 10/1986 | Japan | 428/447 |
| 2003985 | 1/1987 | Japan | 428/913 |

OTHER PUBLICATIONS

Patent Abstracts of Japan, vol. 6, No. 61 (M-123) [939], Apr. 20th, 1982.

Patent Abstracts of Japan, vol. 4, No. 33 (M-3, [515], Mar. 21st, 1980; and JP-A-55 7467 (Tokyo Shibaura Denki K.K.) 19-01-1980.

*Primary Examiner*—Bruce H. Hess

*Attorney, Agent, or Firm*—Cushman, Darby & Cushman

[57] ABSTRACT

A thermal transfer dyesheet having a printing surface against which a receptor substrate may be held to receive a thermally transferable dye in response to thermal stimuli applied to the dyesheet, the dyesheet comprising a substrate supporting a dyecoat comprising the thermally transferable dye dissolved in or dispersed throughout a polymeric binder, characterized in that the polymeric binder comprises a thermoset silicon composition; a dyecoat composition for the dyesheet, processes for its preparation, and the use of a thermoset silicone composition in the dyecoat.

7 Claims, No Drawings

THERMAL TRANSFER DYESHEET

This is a continuation of application Ser. No. 06/831,722, filed Feb. 21, 1986, which was abandoned upon the filing hereof.

The invention relates to dyesheets for thermal transfer printing, in which one or more thermally transferable dyes are caused to transfer from a dyesheet to a receiving sheet in response to a thermal stimulus, dyecoats therefor, processes for their preparation, and the use of certain polymers therein.

Transfer printing has long been used as a means of providing textiles with a decorative pattern, by pressing against them a paper carrying thermally transferable dyes printed onto it in the form of the desired pattern, and applying heat uniformly to the whole area for as long as may be necessary to transfer the preformed pattern to the textile. A more recent development of this is the proposal to use a dyesheet having a substantially uniform distribution of dye, and to produce the desired pattern during the thermal transfer operation by heating only selected areas of the dye sheet. In this way individual letters or numbers can be transferred either whole or in bits, or pictures can be built up pixel by pixel. It is to the dyesheets for this more recent development of forming the desired pattern or information by transfering only selected areas of dyes, to which the present invention particularly relates.

The selected areas of the dyesheet may be heated, for example by using a thermal print head or addressable laser, both being particularly suited to computer control in respect of the position of the areas to be heated and to the degree of heating, and in this manner hard copies of still pictures, including coloured pictures (e.g. by printing different colours sequentially), or data and other information, can be reproduced directly from magnetic disks or tapes, laser-readable disks and other forms of stored electronic signals, under the computer control. A desire for high resolution printing by such methods has led to the replacement of paper as the basis for the dyesheets by more uniform and consistent thermoplastic film, usually polyester film such as "Melinex" polyethyleneterephthalate film, the dyes being held on the surface of the film by a suitable polymeric binder. However, for high speed printing (to which such processes are particularly suited) it is necessary to give short duration stimuli, which in turn require higher temperatures in order to provide sufficient thermal energy, but this has led in the past to local melt-bonding between the dyesheet and receptor substrate (which may also be thermoplastic film), thus excessively transferring areas of the dyecoat to the receptor. This can be mitigated to some extent by using cross-linked thermoset resins as binders for the dye, as has previously been suggested. However such solutions have not proved entirely successful, tending at one extreme to restrict or disperse the flow of the dye molecules through the binder to the receptor sheet, or at the other extreme still to permit some adhesion. We have now found that we can minimise the adhesion while retaining a rapid and precise transfer of the dyes, by using thermosetting silicones in the dyesheet.

Accordingly the present invention provides a thermal transfer dyesheet having a printing surface against which a receptor substrate may be held to receive a thermally transferable dye in response to thermal stimuli applied to the dyesheet, the dyesheet comprising a substrate supporting a dyecoat comprising the thermally transferable dye dissolved in or dispersed throughout a polymeric binder, characterised in that the polymeric binder comprises a thermoset silicone composition.

We have found that if a silicone composition is mixed into the dyecoat, either as the polymeric binder itself or in addition to a polymeric binder, we obtained protection against adhesion and/or ease in avoiding adhesion problems. In particular we found that we could transfer an appropriate quantity of dye in a shorter time and at lower temperatures when using the present silicone binders than when using known binders such as ethyl hydroxyethylcellulose and "Klucel" (hydroxypropylcellulose). Whatever the mechanism or other reasons for such results the improvements were sometimes found to be substantial.

The present invention also provides a dyecoat composition for use in the dyesheet of the present invention comprising a thermally transferable dye dissolved in or dispersed throughout a polymeric binder, characterised in that the polymeric binder comprises a thermosetting silicone composition.

The present invention further provides the use of a thermosetting silicone composition as a matrix binder for a dissolved or dispersed thermally transferable dye in a thermal transfer dyecoat.

The optimum proportion of silicone to other polymeric materials can vary according to the nature of the silicone, its degree of cross-linking, its compatibility with the dyes used and the nature of the other polymeric materials. However, in general we prefer the thermoset silicone to provide at least 10%, for example 50% by weight of the binder.

Silicones within the thermosetting silicone composition which are generally available include polysiloxane resins which are designed to be cured by platinum-based catalysts, and those designed to be cured by tin-based catalysts, the former generally being the more rapidly cured and being the more commonly used for other purposes. However, for use as a binder within the dyecoat, we prefer the tin catalysed resins as these appear generally to be more compatible with the thermally transferable dyes. With the platinum catalysed systems, incompatibility may manifest itself in the form of catalyst poisoning, leading to lower degrees of cross-linking, or by migration of the dye molecules through the cross linked silicone to exude from the surface. Such problems however, and their degree, vary from dye to dye, and while we found that many of the dyes tested gave severe compatibility problems with platinum-based catalysed resins, there were others which were not so affected.

Suitable polymers for any additional binder for the dyecoat include conventional binders for such purposes for instance cellulose derivatives such as cellulose ethers and esters, such as alkyl hydroxyalkylcelluloses, for example methyl and ethyl hydroxyethylcellulose.

The thermally transferable dyes can be soluble in the binder or dispersed throughout it. The optimum quantity may be limited by solubility or on compatability grounds, but when testing some dispersions we found that the highest dye concentrations did not give the highest optical densities of transferred dye, peak optical densities (when the silicone composition is the dyecoat binder) occuring when using dye concentrations of about 5 g per 100 g of silicone resin solution (containing about 30% silicone solids), ranges of from 2 to 8 g per 100 g of solution giving the best results under the conditions of testing, as described in more detail in Example 1 below. Usable results were, however, obtained over a much wider range of about 1 to 20 g/100 g of silicone solution.

The thickness of the dyecoat determines the quantity of dye available for transfer from any specific composition. When using dye concentrations within our preferred ranges above, particularly suitable thicknesses for the dyecoat ranged from 1 to 10 μm, although less than 5 μm is preferred. For high solubility dyes, or highly dispersible dyes in dispersions, dyecoats of about 2 μm thickness are generally appropriate.

The present invention also provides a process for preparing a dyesheet of the present invention, characterised by coating a dyecoat comprising a thermally transferable dye and a thermosetting silicone composition onto a substrate and thermosetting the silicone composition.

Most of the normal film-coating techniques can be used to spread the dyecoat. We have successfully used Meyer bars, for example, but generally prefer gravure rollers as these give particularly good control over the process.

Conventional curing techniques may be used for thermosetting. For example, with the tin- or platinum-catalysed curable resins referred to hereinbefore, any coating solvent or dispersant is removed by evaporation and the resin set by heating for 10 to 30 sec at 80°-120° C.

At the present state of this technology, dyesheets have a single dye colour dispersed throughout a polymeric binder, and spread uniformly over the supporting substrate although that single colour may be made up of an intimate mixture of different dye molecules. For multicolour prints, the various colours are transferred sequentially, either by changing the dyesheet altogether, or more usually by moving on a dyesheet roll having large blocks of colour which are placed between the print head and the receptor sheet in turn. However, it is envisaged that a future dyesheets may contain several colours, probably three, arranged in very small clusters or narrow adjacent rows, such that each pixel could be printed with the appropriate colour or combination of the colours according to which minute area is heated, thereby avoiding having to move the dyesheet to change the colour. Each cluster or row being respectively very small or narrow as it would determine the ultimate resolution of the system, yet being sufficiently wide to be independently addressable by the means providing the thermal stimulus. Difficulties envisaged for such dye sheets reside in registration of the dye sheet with respect to the means for providing the thermal stimulus, such that the correct colour is transferred for each pixel, but such registration problems are not the subject of the present invention. However such dyesheets would appear to be substantially uniform to the naked eye, and the process of heating only selected areas of the dyes to build up a picture pixel by pixel would be essentially the same. Thus any melt-adhesion problems arising during printing would be derived from the materials and temperatures employed, rather than the arrangement of the dyes, and the provisions of the present invention would be equally applicable and advantageous to such multi-dye dyesheets. It is therefore not intended that they should be excluded in or by any reference herein to a uniform dyesheet or dyecoat.

The invention is illustrated by reference to the following Examples:

EXAMPLE 1

This Example illustrates the use of a dissolved dye in a single-phase dyecoat of the invention.

Various dyecoats were cast from the following solutions, onto a "Melinex" polyester film

| | | parts by weight |
|---|---|---|
| Silcolease | 425 | 100 |
| Cross-linking agent | 62A | 5 |
| Catalyst | 62B | 5 |
| Solvent | | 250 |
| Dye | | 2 to 20 |

Silicolease 425 is a blend of silicone polymers sold as a solution with 30 weight % solids content, by Imperial Chemical Industries PLC, for use with a crosslinking agent and tin-based catalyst identified by the manufacturers as catalysts 62A and 62B respectively. The solvent used was methyl ethyl ketone, although methylene chloride appeared to be equally effective.

The dyes were all thermally transferable dyes soluble in the silicone solution, and included "Dispersol" Yellow B6G (a yellow dye, manufactured and marketed under this trade name by Imperial Chemical Industries PLC).

In preparing the coating compositions, the silicone resin was diluted with the solvent, and the dye added and dissolved. The catalyst 62A and 62B were then mixed together and added to the solution, to provide the dyecoat composition. This was coated onto the Melinex substrate, the solvent removed, and the coated film heated for about 20 seconds at 90° C. The dyecoats they produced were typically about 2-4 μm thick. When used in a thermal printer, the dye sheets were very easy to peel away from receptor sheets after printing.

After printing with Dispersol B6G, the optical densities of the dye transferred to the receiver sheets, were measured for a range of different dyestrengths in the dyecoat, using a Sakura digital densitometer PDA 65, manufactured by Konishiroku, at a wavelength of 436 μm. The optical densities measured under those conditions increased with increasing dye concentrations in the dyecoat, up to an optical density of 2 when using a dye concentration of 5 g per 100 g of Silcolease resin (as 30 wt % solids solution) and then started to reduce with further increases in dye concentrations. Satisfactory quantities of dye were transported from dye coats containing 2 to 8 g of dye per 100 g of Silcolease resin.

EXAMPLE 2

This example illustrates the use of a dispersed solid dye (in place of the solution of Example 1) and the inclusion of a polymeric binder material in addition to the silicone resin.

A solid dye dispersion was prepared for "Dispersol" Red B2B dye, including ethyl hydroxyethylcellulose (EHEC) as binder precursor, by milling the components to a dye particle size of at most 1 micron using as solvent a mixture of SPB3 petroleum distillate and isopropanol. The dye dispersion had the following composition.

| | parts by weight |
|---|---|
| Red B2B dye | 5 |

-continued

| | parts by weight |
|---|---|
| EHEC | 5 |
| Dispersing agent | 3 |
| Solvent | 100 |

This dye dispersion was then used in a coating composition having the following proportions:

| | | |
|---|---|---|
| Silcolease resins | 425 | 100 |
| Dye Dispersion | | 200 |
| Crosslinking agent | 62A | 3 |
| Catalsyt | 62B | 3 |
| Petroleum Ether (bp 80/100C) | | 100 |

The coating composition was spread onto a film of "Melinex" polyester film using a Meyer bar, the solvent removed and the coating heated briefly to cross-link the resins, as described in the previous example, to complete the dyesheet. On passing the dyesheet through the thermal printer, the amount of dye transferred corresponded well with the size of each energy pulse supplied, giving a predictable grey scale on the receiver sheet. The maximum optical density achieved with this composition, as measured on the Sakura densitometer was 1.44 at a wavelength of 546 μm.

The silicone resin and EHEC were found to be incompatible even in solution, and considerable care was required to stabilise the coating composition before curing. Microscopic examination showed the dye to be present in small clusters, apparently consisting of phase separated EHEC dispersed in a continuous phase of crosslinked silicone.

When using a thermal printer to transfer the dye, rapid transfer was obtained, with no noticeable evidence of any increased lateral flow of dye molecules to reduce the resolution.

By contrast substantial adhesion occured when using the same printer on an area having only the dye in EHEC dyecoat, i.e. without any silicone composition as binder.

In the two examples the printer head reached a temperature of about 360° C. in about 10 ms, except where less energy was used when investigating the effects of lower energies and the grey scales thereby produced. Other dyes may require different temperatures and/or pulse durations to achieve optimum thermal transfer.

Dyesheets of the present invention were prepared similarly to Example 1 using the following compositions:

EXAMPLE 3

| | | parts by weight |
|---|---|---|
| Dispersol Red B2B dye | | 5 |
| Silicone resin (30% solids solution) EP6553 | ICI | 200 |
| Cross-linking agent | ICI | 2 |
| Platinum-based catalyst EP6530 (15% in toluene) | ICI | 8 |
| Methyl ethyl ketone | | 480 |
| (Curing at 100° C. for 15 sec) | | |

EXAMPLE 4

| | parts by weight |
|---|---|
| Dispersol Red B2B dye | 10 |
| Silicone (30% solids solution) 425 | 200 |
| Cross-linking agent 62A | 6 |
| Tin-based catalyst 62B | 6 |
| Dichloromethane | 640 |
| Petroleum ether (bp 80–100° C.) | 160 |

EXAMPLE 5

As for Example 4, omitting dichloromethane from dye dispersion.

EXAMPLES 6 AND 7

As for Examples 4 and 5 adding Monflor 51 surfactant (1 part by weight) to the dye dispersion.

Dyesheets of the present invention were prepared similarly to Example 2 using the following compositions:

EXAMPLES 8 TO 11

| | parts by weight |
|---|---|
| Dye dispersion | |
| EHEC | 5, 10, 20, 40 |
| Dispersol Red B2B dye | 2.5, 5, 10, 20 |
| Toluene | 242.5, 485, 970, 1940 |
| Coating composition | |
| Silicone (30% solids solution) EP 6553 | 62.5 |
| Cross-linking agent EP6552 | 1.25 |
| Platinum-based catalyst EP6530 (15% in toluene) | 5 |
| Toluene | 600 |

EXAMPLE 12

This example illustrates the use of a dissolved dye dispersed in a two-phase dyecoat of the invention. The surfactant silicone was high speed/high shear mixed into the dye emulsion, and the resultant product similarly mixed into the coating composition.

| | parts of weight |
|---|---|
| Dye emulsion | |
| EHEC | 10 |
| Rubine CB dye | 5 |
| Methyl ethyl ketone | 117.5 |
| Cyclohexanone | 117.5 |
| Surfactant silicone (ICI ref no S1249/45) | 0.9 |
| Coating composition | |
| Silicone (30% solids solution) EP6553 | 33 |
| Cross-linking agent EP6552 | 0.33 |
| Platinum-based catalyst EP6530 | 1.33 |
| Methyl ethyl ketone | 100 |
| Cyclohexanone | 100 |

"EXAMPLE 13

As for Example 12, using Dispersol Yellow B6G (ICI) as the dye."

I claim:

1. A thermal transfer dyesheet having a printing surface against which a receptor substrate may be held to receive a thermally transferable dye in response to thermal stimuli applied to the dyesheet, the dyesheet comprising a substrate supporting a dyecoat comprising the thermally transferable dye dissolved in or dispersed throughout a polymeric binder, characterised in that the polymeric binder comprises a thermoset silicone composition.

2. A dyesheet according to claim 1, characterised in that the polymeric binder is a mixture of polymers wherein at least 10% by weight of the binder is the thermoset silicone composition.

3. A dyesheet according to claim 1, characterised in that the dyecoat binder comprises a polymeric binder, in addition to the thermoset silicone composition, which is 50% or less by weight of the total binder.

4. A dyesheet according to claim 1, characterised in that the thermoset silicone composition comprises a polysiloxane resin cured with a tin-based catalyst.

5. A dyesheet according to claim 1, characterised in that the dye concentration in the dyecoat is from 2 to 8 g dye per 30 g silicone, and the dyecoat is less than 5 $\mu$m thick.

6. In a thermal transfer printing process wherein a thermal transfer dyesheet having a printing surface against which a receptor substrate is held to receive a thermally transferable dye in response to thermal stimuli applied to the dyesheet, the dyesheet comprising a substrate supporting a dyecoat comprising the thermally transferable dye dissolved in or dispersed throughout a polymeric binder, the improvement which comprises using, as the dyesheet, one in which the polymeric binder comprises a thermoset silicone composition.

7. A thermal transfer dyesheet having a printing surface against which a receptor substrate may be held to receive a thermally transferable dye in response to thermal stimuli applied to the dyesheet, the dyesheet comprising a substrate supporting a dyecoat comprising the thermally transferable dye dissolved in or dispersed throughout a polymeric binder, characterised in that the polymeric binder comprises a thermoset silicone composition comprising a polysiloxane resin cured with a tin- or platinum-based catalyst.

* * * * *